US007591046B2

(12) United States Patent
Zetti

(10) Patent No.: US 7,591,046 B2
(45) Date of Patent: Sep. 22, 2009

(54) SPRUNG HINGE FOR SUPPORTING A CLOSURE ELEMENT

(76) Inventor: Daniele Zetti, Viá Monviso, 107, 41100 Modena (IT)

( * ) Notice: Subject to any disclaimer, the term of this patent is extended or adjusted under 35 U.S.C. 154(b) by 376 days.

(21) Appl. No.: 11/453,858

(22) Filed: Jun. 16, 2006

(65) Prior Publication Data

US 2006/0282983 A1 Dec. 21, 2006

(30) Foreign Application Priority Data

Jun. 21, 2005 (IT) ..... MO2005A0156

(51) Int. Cl.
*E05F 1/08* (2006.01)

(52) U.S. Cl. ..... 16/286; 16/366

(58) Field of Classification Search ..... 16/366, 16/370, 286, 287, 294, 277, 302, 278, 288, 16/211, 291, 296; 49/211
See application file for complete search history.

(56) References Cited

U.S. PATENT DOCUMENTS

| | | | | | |
|---|---|---|---|---|---|
| 3,673,635 | A * | 7/1972 | Cencioni | 16/358 |
| 4,075,735 | A * | 2/1978 | Rock et al. | 16/278 |
| 4,470,169 | A * | 9/1984 | Lautenschlager et al. | 16/291 |
| 4,736,491 | A * | 4/1988 | Mertes | 16/358 |
| 4,837,894 | A * | 6/1989 | Lin | 16/288 |
| 5,035,026 | A * | 7/1991 | Carlo et al. | 16/288 |
| 6,141,832 | A * | 11/2000 | Salice | 16/366 |
| 6,243,918 | B1 * | 6/2001 | Zetti | 16/298 |
| 6,374,459 | B1 * | 4/2002 | Zetti | 16/366 |
| 6,477,807 | B1 * | 11/2002 | Crondahl et al. | 49/211 |
| 6,568,035 | B2 * | 5/2003 | Zetti | 16/370 |
| 2001/0025398 | A1 * | 10/2001 | Zetti | 16/370 |
| 2005/0188505 | A1 * | 9/2005 | Bennett | 16/366 |
| 2007/0006420 | A1 * | 1/2007 | Zetti | 16/287 |

FOREIGN PATENT DOCUMENTS

| | | |
|---|---|---|
| DE | 18 31 126 U | 5/1961 |
| EP | 1 231 346 A | 8/2002 |
| WO | WO 03/038219 A | 5/2003 |

* cited by examiner

*Primary Examiner*—Victor Batson
*Assistant Examiner*—Matthew Sullivan
(74) *Attorney, Agent, or Firm*—Modiano & Associati; Albert Josif; Daniel J. O'Byrne

(57) ABSTRACT

A sprung hinge for supporting closure elements, comprising: a first articulated quadrilateral and a second articulated quadrilateral, which share a first lever and a second lever and have as their base element respectively a plate for coupling to a fixed element and a plate for fixing to a closure element; elastic elements, which act at opposite points of one of the articulated quadrilaterals, and an auxiliary elastic element, arranged in series to the elastic elements to act between opposite points of the other of the articulated quadrilaterals.

12 Claims, 6 Drawing Sheets

SPRUNG HINGE FOR SUPPORTING A CLOSURE ELEMENT

The present invention relates to a sprung hinge for supporting a closure element.

BACKGROUND OF THE INVENTION

In the field of furniture, particularly in the field of furniture for furnishing caravans and/or campers, such as wall-mounted cabinets, lockers or the like, it is known to close the compartments of these pieces of furniture with plate-like closure elements, i.e., doors, which are articulated to the fixed structure of said pieces of furniture so that they can be moved from a closed configuration, in which they are arranged on a substantially vertical plane, to an open configuration, in which they are arranged on a substantially horizontal plane.

Sprung hinges for the articulation and support of these closure elements are known which comprise two articulated quadrilaterals, which share a first lever and a second lever and have as their base element respectively a plate for coupling to a fixed element of the cabinet or the like and a plate for fixing to the closure element.

Known sprung hinges further comprise a spring which acts between two separate parts of the two quadrilaterals or acts on mutually opposite parts of one of them.

In particular, again with reference to doors of wall-mounted cabinets, the coupling plate is secured, by way of threaded means such as screws, to the wall that delimits in an upper region the cabinet and on the surface that faces toward the inside of said cabinet. The fixing plate is fixed to the door on the surface that faces the inside of the cabinet in the closed configuration.

In the closed configuration of the hinge, the fixing plate and the coupling plate are arranged on planes of arrangement which are mutually perpendicular when the door is arranged so as to close the compartment of the cabinet.

In the open configuration of the hinge, the fixing plate and the coupling plate are arranged on planes of arrangement which are mutually parallel when the door is arranged on a substantially horizontal plane.

With particular reference to the use of cabinets, lockers or the like in relatively small environments, sprung hinges are also known which are capable of reducing the space occupation of the door in the open configuration of the hinge.

In particular, in the open configuration of these hinges, the angle measured between the face of the plane of arrangement of the coupling plate that faces the compartment of the cabinet and between the face of the plane of arrangement of the fixing plate that is designed to face, in the closed configuration, the inside of the cabinet, is substantially greater than $\pi$ rad.

With respect to the known hinges described above, this allows to obtain a further upward opening of the door and therefore obtain a reduced hindrance of the movements of a user of the cabinet within a small environment, such as for example a caravan or a camper.

However, these sprung hinges are not free from drawbacks, including the fact that in the open configuration the spring that acts between two mutually opposite points of one of the quadrilaterals and acts in contrast with the weight force of the door is subject to partial compression and does not ensure the chosen placement of said door, in which the breadth of the angle described above is equal to the set maximum breadth.

The downward action of the weight of the door in fact tends to close the door partially, causing a consequent greater space occupation of the door and hindering user access to the compartment of the cabinet.

Moreover, again with particular reference to application to wall-mounted cabinets of caravans or campers, the elastic action applied by the spring and suitable to keep the hinge in the closed configuration is not such as to prevent the accidental opening of the door, for example when the caravan or camper is moving on a road with bends, with consequent escape of the content of said cabinet.

SUMMARY OF THE INVENTION

The aim of the present invention is to eliminate the drawbacks noted above of known sprung hinges, by providing a sprung hinge which allows stable positioning of a closure element with respect to a fixed element both in a closed configuration and in an open configuration of the hinge.

An object of the present invention is to reduce the space occupation of the closure element in the open configuration.

Within this aim, another object of the present invention is to provide a sprung hinge which is simple, relatively easy to provide in practice, safe in use, effective in operation, and has a relatively low cost.

This aim and these and other objects that will become better apparent hereinafter are achieved by the present sprung hinge for supporting closure elements, comprising: a first articulated quadrilateral and a second articulated quadrilateral, which share a first lever and a second lever and have as their base element respectively a plate for coupling to a fixed element and a plate for fixing to a closure element; elastic means, which act between mutually opposite points of one of said first and second articulated quadrilaterals, the hinge having a closure configuration, in which the breadth of the angle formed between the plane of arrangement of the supporting plate and the plane of arrangement of the connecting plate is substantially equal to $\pi/2$ rad, and an open configuration, in which the breadth of the angle is substantially greater than $\pi$ rad, characterized in that it comprises at least auxiliary elastic means, which are arranged in series to the elastic means, respectively, and act between mutually opposite points of the other of said first and second articulated quadrilaterals.

BRIEF DESCRIPTION OF THE DRAWINGS

Further characteristics and advantages of the present invention will become better apparent from the following detailed description of a preferred but not exclusive embodiment of a sprung hinge for supporting a closure element, illustrated by way of non-limiting example in the accompanying drawings, wherein.

DESCRIPTION OF THE PREFERRED EMBODIMENTS

Figure 2:
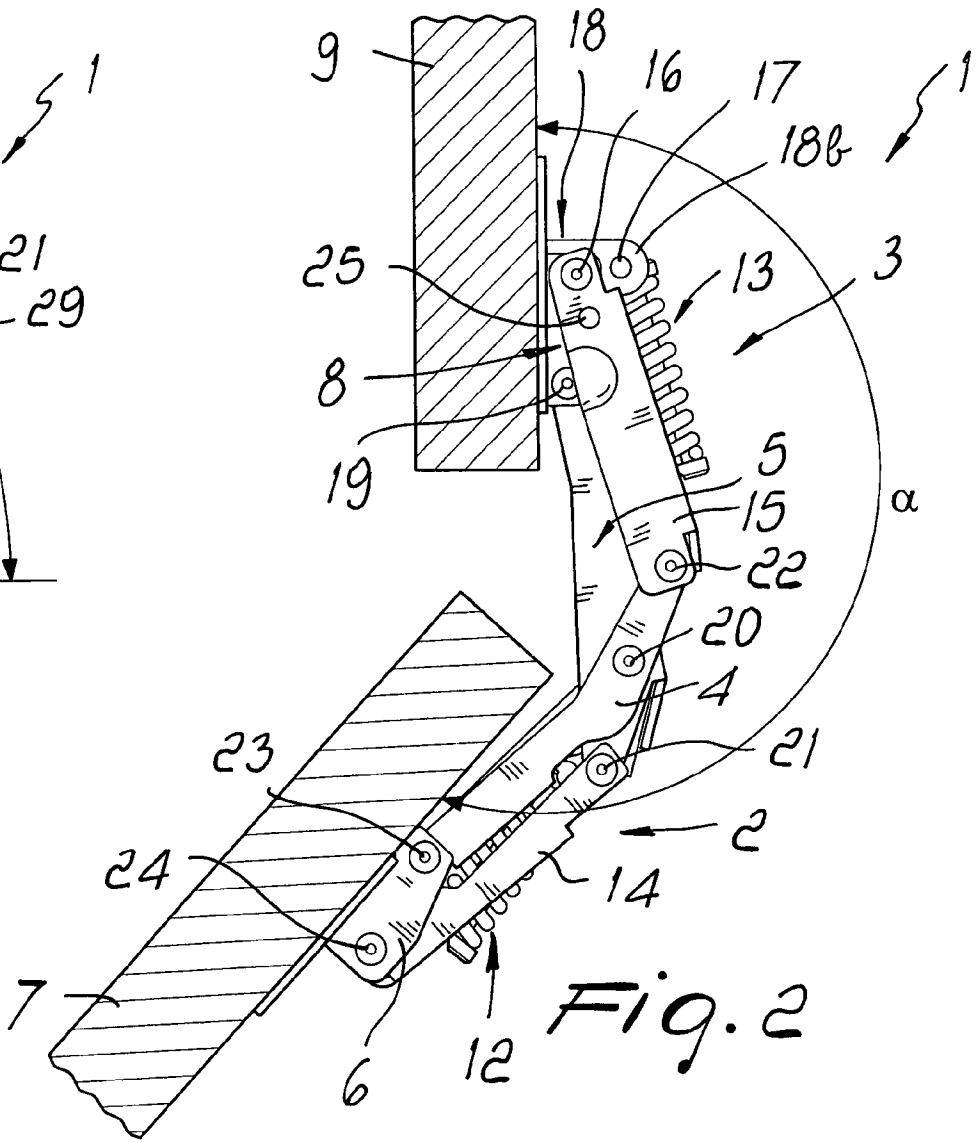
FIG. 2 is a side view of the sprung hinge in the open configuration, according to the invention.
Figure 1:
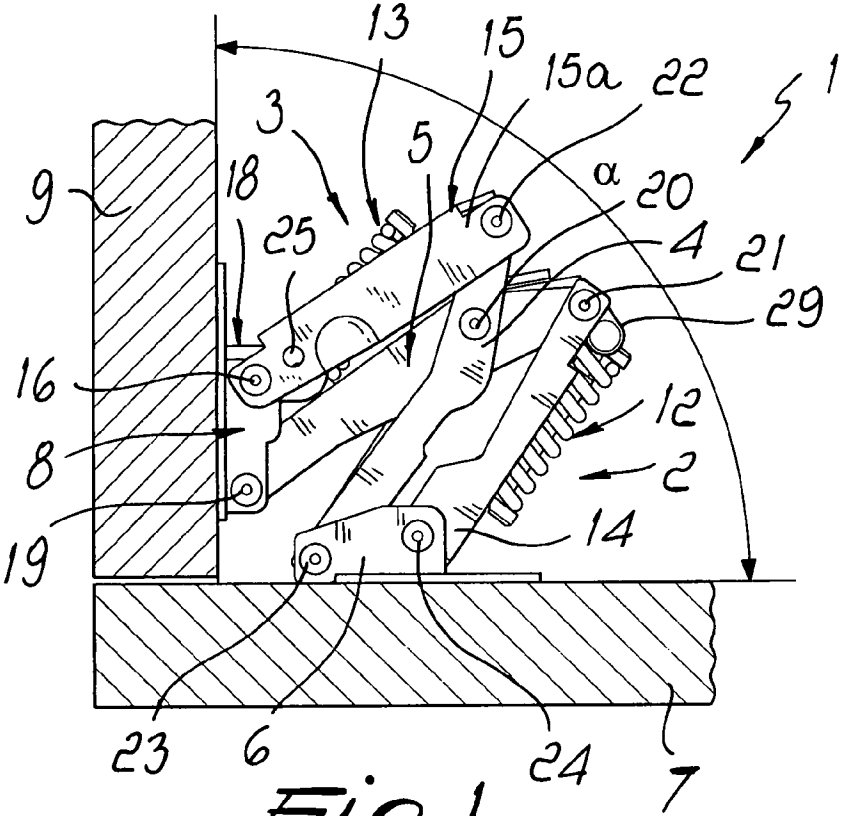
FIG. 1 is a side view of the sprung hinge in the closed configuration according to the invention.
Figure 3:
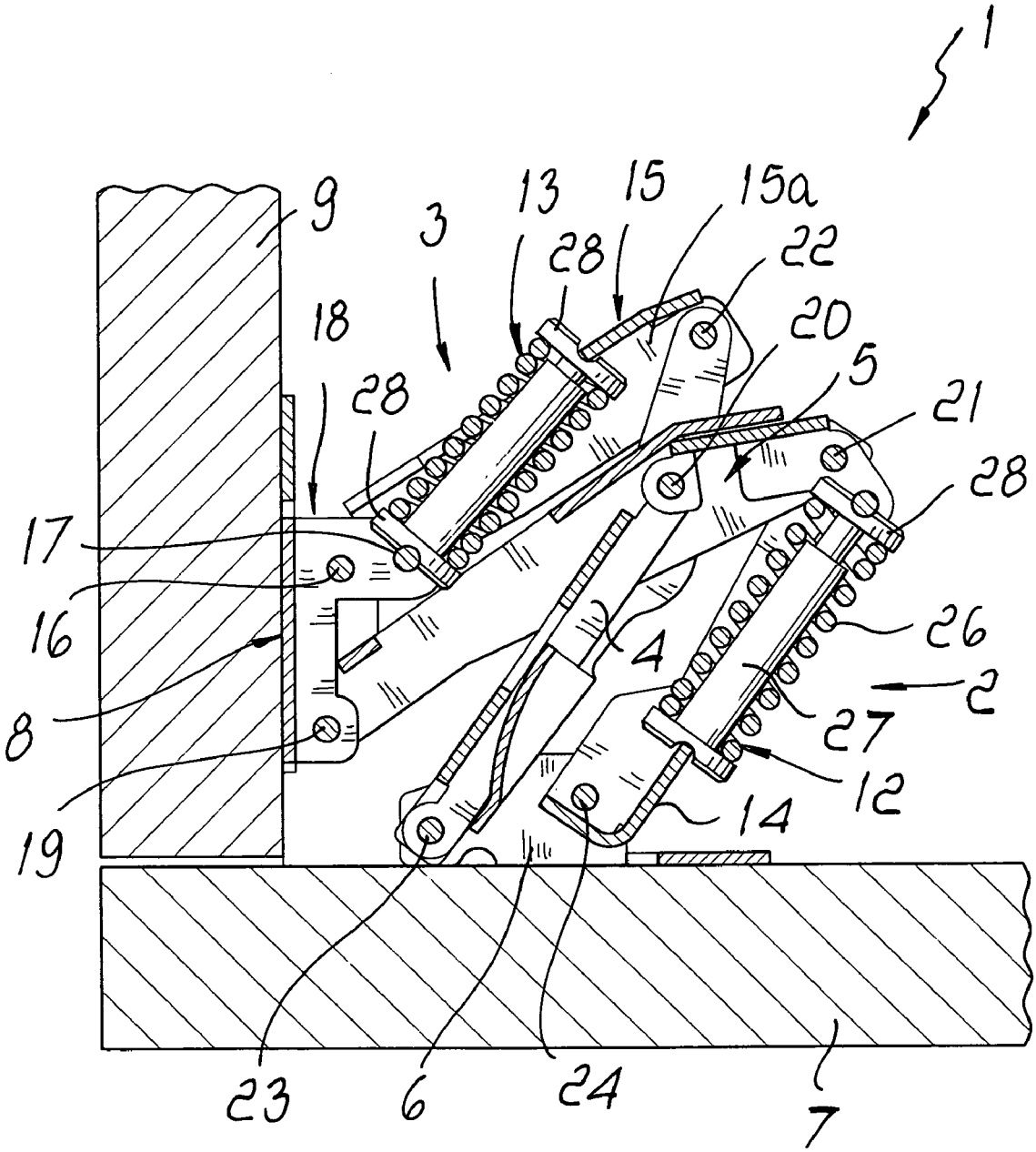
FIG. 3 is a sectional view of the sprung hinge in the closed configuration, according to the invention.
Figure 4:
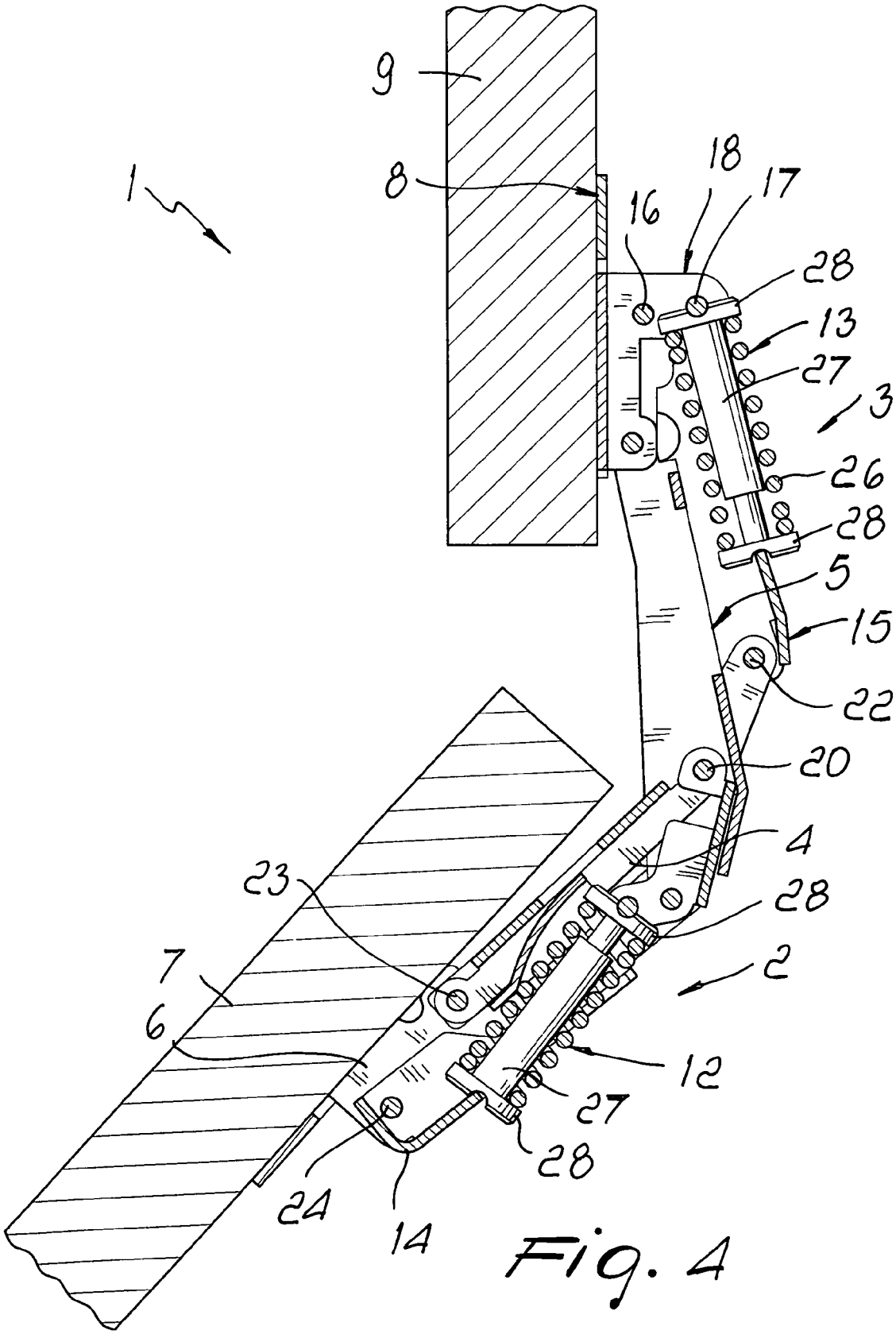
FIG. 4 is a sectional view of the sprung hinge in the open configuration, according to the invention.
Figure 5:
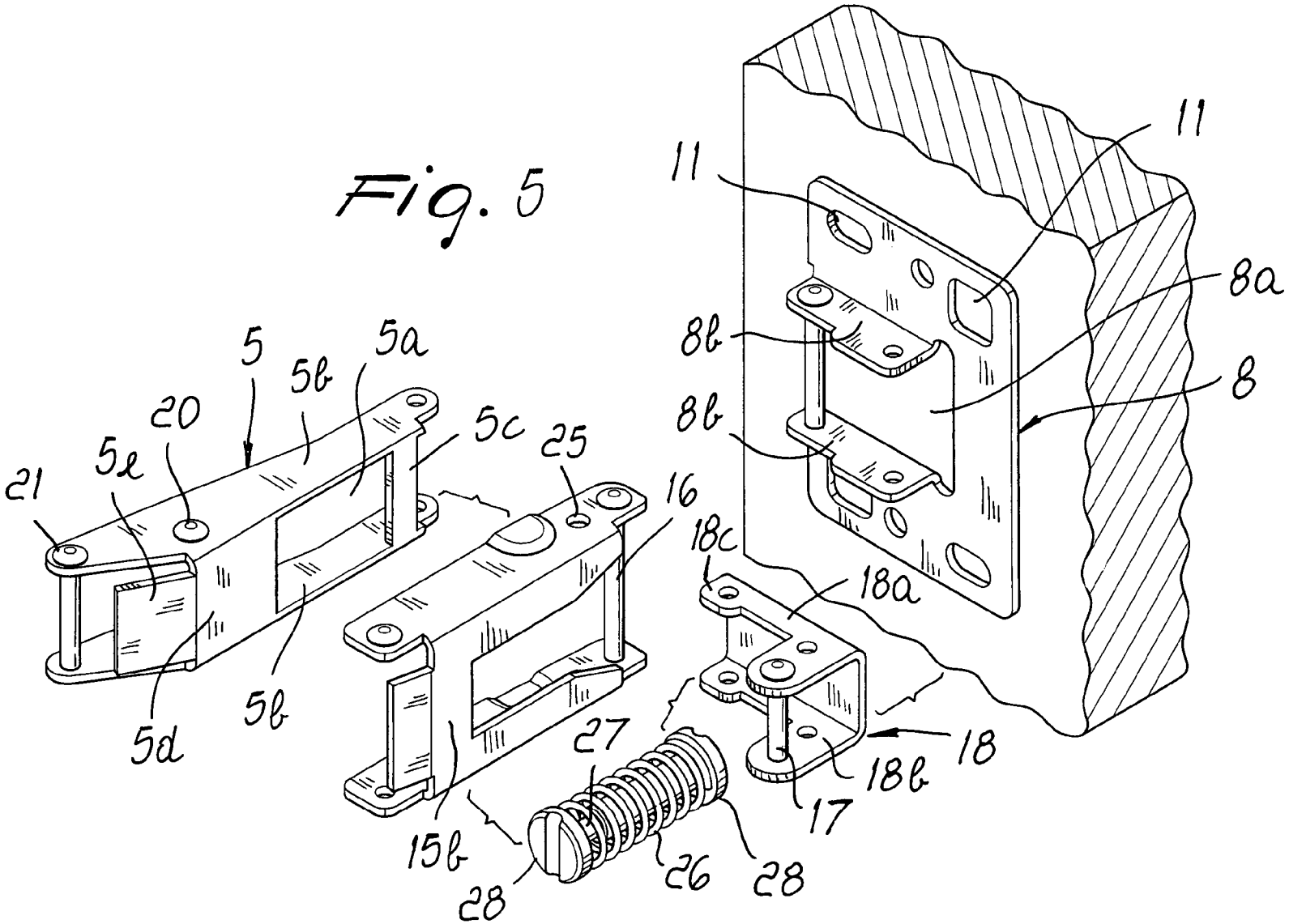
FIG. 5 is an exploded axonometric view of elements of the second articulated quadrilateral according to the invention.
Figure 6:
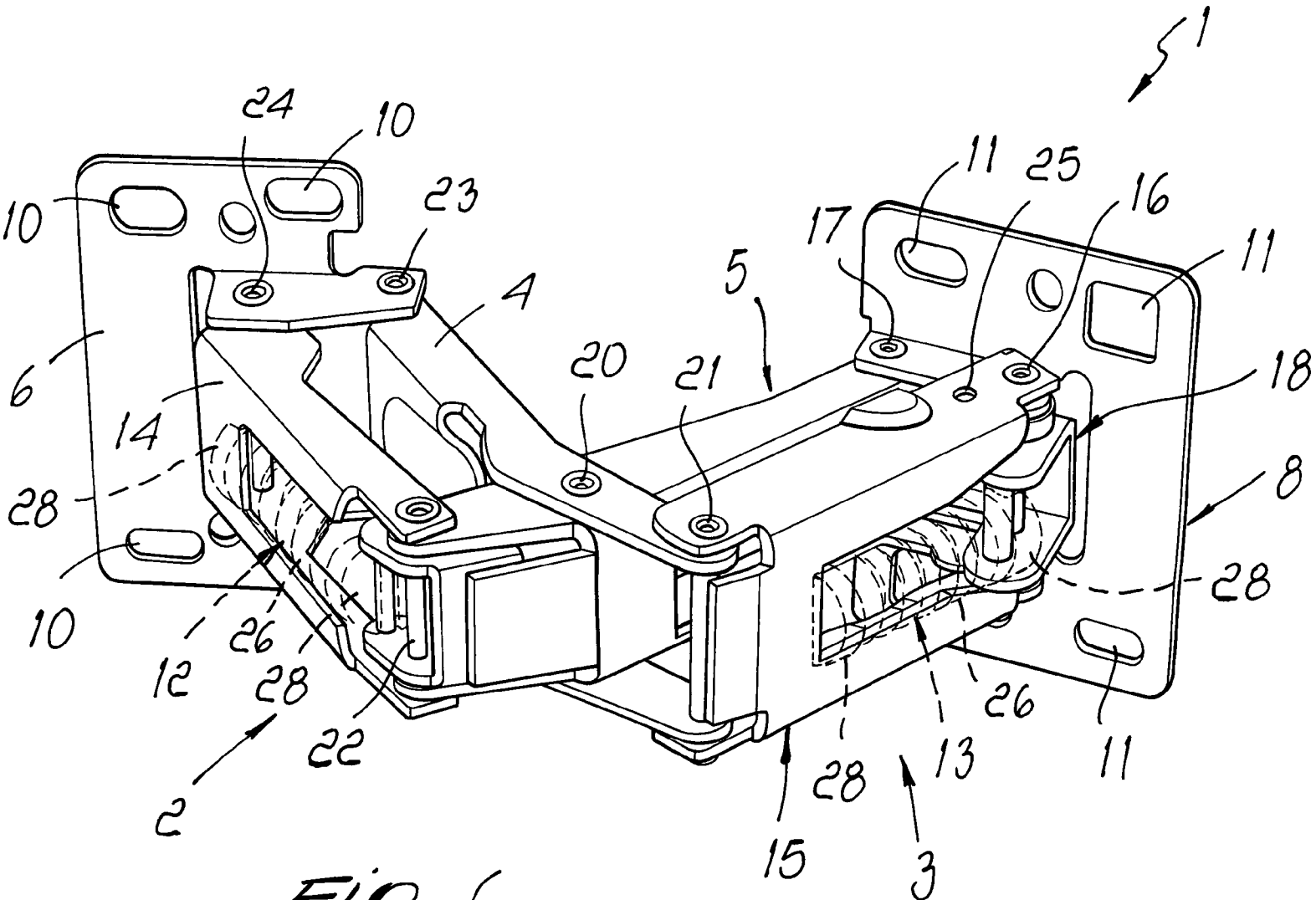
FIGS. 6 and 7 are axonometric views of the sprung hinge according to the invention.
Figure 7:
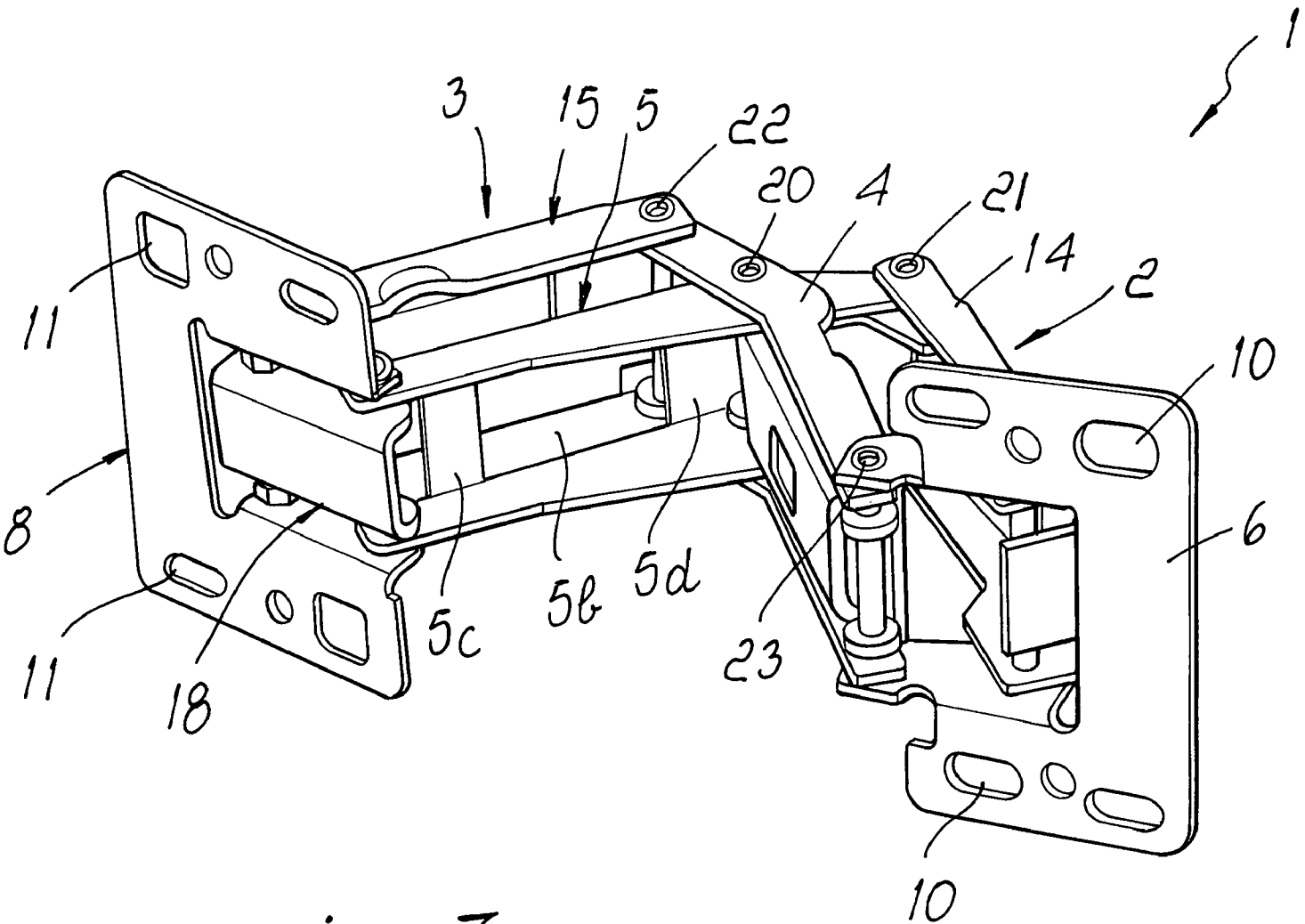

With reference to the figures, the reference numeral 1 generally designates a sprung hinge according to the invention.

The hinge 1 comprises a first articulated quadrilateral 2 and a second articulated quadrilateral 3, which have in common a first lever 4 and a second lever 5 and have, as their base element, respectively a plate 6 for coupling to a fixed element 7 and a plate 8 for fixing to a closure element 9, which is substantially plate-like.

With particular but not exclusive reference to wall-mounted cabinets, the fixed element 7 is constituted by the wall that delimits said cabinet in an upper region and the closure element 9 is constituted by the corresponding door.

The coupling plate 6 is provided with holes 10 for fixing, by way of threaded means such as screws, to the surface of the wall that faces the compartment of the cabinet. Likewise, the fixing plate 8 is provided with holes 11 for fixing, by way of threaded means such as screws, to the surface of the door which in a closed configuration of the hinge 1 faces the compartment. The threaded fixing means may be preassembled to the holes 10, 11 and can be self-tapping with respect to them.

The door, in passing from the closed configuration to an open configuration, rotates about a substantially horizontal axis.

When the hinge 1 is in the closed configuration, the angle formed between the plane of arrangement of the coupling plate 6 and between the plane of arrangement of the fixing plate 8 and designated in the figures by the reference sign $\alpha$ is substantially equal to $\pi/2$ rad (i.e. with a deviation of no more than the normal tolerance of few degrees).

In the open configuration of the hinge 1, the angle $\alpha$ is substantially greater than $\pi$ rad (i.e. greater than 7/6 rad), and in particular is equal to 7/6 $\pi$ rad, allowing, again with reference to wall-mounted cabinets, an arrangement of the door which is substantially inclined upward, with a relatively reduced space occupation thereof.

The hinge 1 is provided with elastic means 12, which act between mutually opposite points of one of the first and second articulated quadrilaterals 2 and 3, and auxiliary elastic means 13, which are arranged in series with respect to the elastic means 12 and act between mutually opposite points of the other of the first and second articulated quadrilaterals 2 and 3.

The first articulated quadrilateral 2 comprises the coupling plate 6, the first lever 4, the second lever 5, and a first arm 14, which are mutually articulated.

The second articulated quadrilateral 3 comprises the fixing plate 8, the first lever 4 and the second lever 5, and a second arm 15, which are mutually articulated.

The elastic means 12 act between the coupling plate 6 and the second lever 5, while the auxiliary elastic means 13 act between the fixing plate 8 and the second arm 15.

The second arm 15 is constituted by two mutually parallel side walls 15*a*, which are joined at one end by a cross-member 15*b* and have opposite ends which are articulated so that they can rotate about a first pivot 16 which is associated with the fixing plate 8.

The auxiliary elastic means 13 are articulated, at one end, to a resting point which is formed by the edge of the cross-member 15*b* which is directed toward the fixing plate 8 and are articulated, at the opposite end, to a second pivot 17, which is associated with the fixing plate 8 and is parallel to the first pivot 16.

The first and second pivots 16 and 17 are fixed to a supporting element 18, which is rigidly associated with the fixing plate 8.

In particular, the supporting element 18 comprises a flat portion 18*a*, which is parallel to the plane of arrangement of the fixing plate 8, and two first lugs 18*b*, which protrude from the flat portion 18*a* in order to support the opposite ends of the first and second pivots 16, 17.

The supporting element 18 further comprises two second lugs 18*c*, which protrude from the flat portion or plate 18*a*, for supporting a third pivot 19 about which the second lever 5 is articulated.

The supporting element 18 is contained within a receptacle 8*a*, which is formed on the fixing plate 8 and comprises an opening which is provided with two mutually opposite and parallel edges, from which two mutually parallel sides 8*b* protrude. The plate 18*a* is anchored to the sides 8*b* by the ends of the first pivot 16 and of the third pivot 19, of which one is shaped like a head and the other is riveted.

The second lever 5 has a containment opening 5*a* for containing the end of the auxiliary elastic means 13 that is articulated to the second pivot 17 when the hinge is in the closed configuration.

In particular, the second lever 5 is formed monolithically and comprises two longitudinal elements 5*b*, which are mutually spaced and substantially parallel and are interconnected by a first dorsal bridge 5*c* and a second dorsal bridge 5*d*, formed respectively proximate to the portion of the second lever 5 that is articulated to the plate 18*a* and proximate to the portion that is articulated to the first lever 4 by means of a fourth pivot 20.

Further, the second lever 5 is articulated to the first arm 14 of the first articulated quadrilateral 2 by means of a fifth pivot 21.

The containment opening 5*a* is formed between the longitudinal elements 5*b* and in particular is delimited by the longitudinal elements 5*b*, by the first dorsal bridge 5*c* and by the second dorsal bridge 5*d*.

The first lever 4 is instead articulated at one end to the second arm 15, on the end of the faces 15*a* that lie proximate to the cross-member 15*b*, by means of a sixth pivot 22 and, at the opposite end, to the coupling plate 6 by means of a seventh pivot 23.

The first arm 14 and the coupling plate 6 are mutually articulated by an eighth pivot 24, which is separate with respect to the seventh pivot 23.

Advantageously, the second arm 15 further has holes 25, along the side walls 15*a* and proximate to the end articulated to the fixing plate 8, which are suitable for the insertion of a locking pin. Said locking pin is suitable to make contact with the sides 8*b* of the fixing plate 8 during transition from the closed configuration to the open configuration of the hinge 1, so as to limit the breadth of the angle $\alpha$ to $\pi$ rad, with consequent arrangement of the door on a substantially horizontal plane.

The elastic means 12 and the auxiliary elastic means 13 comprise at least one spring 26 and two guiding elements 27, which are mutually coupled so that they can slide axially and telescopically with respect to each other.

In particular, the guiding elements 27 are constituted by a cylinder and a piston, which are connected so that they can slide with respect to each other at one end and have, at the opposite end, a respective head 28, while the spring 26 is constituted by a helical spring which is fitted coaxially on said cylinder and on said piston and acts between the heads 28.

As an alternative, the elastic means 12 and the auxiliary elastic means 13 are of the type of elastic telescopic capsules, constituted by bottoms and lids which are mutually opposite and can slide with respect to each other and between which the spring 26 is contained.

The heads 28 or the bottoms/lids of the elastic means 12 make contact respectively with the first arm 14 and with a contact element 29, which is articulated by means of the fifth pivot 21 to the end of the second lever 5 that lies opposite the end connected to the plate 18. The movement of the contact element 29 about the fifth pivot 21 is limited by the engagement of a protrusion of the contact element 29 with a tab 5*e*, which protrudes from the second dorsal bridge 5*d* of the second lever 5.

The heads 28 or the bottoms/lids of the auxiliary elastic means 12 make contact respectively with the edge of the cross-member 15*b* and with the second pivot 17.

In practice it has been found that the described sprung hinge achieves the intended aim and objects, ensuring stable positioning of a closure element with respect to a fixed element both in a closed configuration of the hinge and in an open configuration of the hinge by using elastic means and auxiliary elastic means arranged in series to each other.

The invention thus conceived is susceptible of numerous modifications and variations, all of which are within the scope of the appended claims.

All the details may further be replaced with other technically equivalent elements.

In practice, the materials used, as well as the contingent shapes and dimensions, may be any according to requirements without thereby abandoning the scope of the protection of the appended claims.

The disclosures in Italian Patent Application No. MO2005A000156 from which this application claims priority are incorporated herein by reference.

What is claimed is:

1. A sprung hinge for supporting closure elements, comprising: a first articulated quadrilateral and a second articulated quadrilateral, provided with and sharing a first lever and a second lever; a coupling plate for coupling the first lever to a fixed element; a fixing plate for fixing the second lever to a closure element; elastic means, to act between mutually opposite points of a first one of said first and second articulated quadrilaterals, the hinge having a closure configuration, in which a breadth of an angle formed between a plane of arrangement of said coupling plate and a plane of arrangement of said fixing plate is substantially equal to $\pi/2$ rad, and an open configuration, in which the breadth of said angle is substantially greater than $\pi$ rad; and auxiliary elastic means, which are arranged in series to said elastic means, respectively, and act between mutually opposite points of a second one of said first and second articulated quadrilaterals, wherein each one of said first and second articulated quadrilaterals comprises said fixing plate, said first and second levers and one of a first and second arms, respectively, which are mutually articulated, said auxiliary elastic means acting between said fixing plate and said one of said first and second arms of one of said first and second articulated quadrilaterals and wherein said one of said first and second arms is constituted by two side walls which are mutually parallel, by a cross-member that joins said side walls which have opposite ends articulated so as to be rotatable about a first pivot coupled with said corresponding fixing plate, an edge of said cross-member forming a resting and articulation point for a first end of said auxiliary elastic means, a second end of said auxiliary elastic means being articulated to a second pivot, which is coupled with said fixing plate and is arranged parallel to said first pivot.

2. The hinge of claim 1, comprising a supporting element for supporting said first and second pivots, which is rigidly associated with said fixing plate.

3. The hinge of claim 2, wherein said supporting element comprises a flat portion, which is parallel to a plane of arrangement of said fixing plate, and two first lugs, which protrude from said flat portion, for supporting opposite ends of said first and second pivots.

4. The hinge of claim 3, wherein said supporting element comprises two second lugs, which protrude from said flat element and support a third pivot, which is parallel to said first and second pivots, said first and second levers being articulated around said third pivot.

5. The hinge of claim 2, wherein said fixing plate comprises a receptacle for accommodating said supporting element.

6. The hinge of claim 5, wherein said receptacle comprises two mutually opposite and parallel edges, from which corresponding sides protrude, said flat portion being anchored to said sides.

7. The hinge of claim 1, wherein said side walls comprise respective holes proximate to an end that is articulated to said fixing plate in which a locking pin is insertable to limit a breadth of said angle to $\pi$ rad in said open configuration.

8. The hinge of claim 1, wherein at least one of said first and second levers comprises an opening for containing an end of said auxiliary elastic means that is articulated to said second pivot, the hinge being in said closed configuration.

9. The hinge of claim 8, wherein at least a first one of said first and second levers comprises two longitudinal elements, which are mutually spaced and substantially parallel and rigidly coupled and are articulated, at one end thereof, to said first pivot and, at an opposite end, to a fourth pivot, which is supported by a second other one of said first and second levers, said containment opening being formed between said longitudinal elements.

10. The hinge of claim 1, wherein said auxiliary elastic means comprise at least one spring.

11. The hinge of claim 10, wherein said at least one spring is a helical spring.

12. The hinge of claim 11, wherein said auxiliary elastic means comprise two elements fox guiding said at least one spring, which are mutually coupled so as to be slidable axially and telescopically with respect to each other.

* * * * *